US006699314B2

(12) United States Patent
Takeo et al.

(10) Patent No.: US 6,699,314 B2
(45) Date of Patent: Mar. 2, 2004

(54) MOLD RELEASING AGENT FOR CENTRIFUGAL CASTING MOLD

(75) Inventors: Arai Takeo, Wako (JP); Murakami Manabu, Wako (JP); Yokoyama Kouriki, Wako (JP); Nakaya Shoichi, Wako (JP); Miyanishi Masahiro, Wako (JP); Suzuki Sadahiro, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/078,408

(22) Filed: Feb. 21, 2002

(65) Prior Publication Data

US 2002/0157571 A1 Oct. 31, 2002

(30) Foreign Application Priority Data

Feb. 23, 2001 (JP) ..... 2001-049148

(51) Int. Cl.[7] ..... C09D 201/00; B28B 7/36; B28B 7/28; B28B 7/34

(52) U.S. Cl. ..... 106/38.2; 106/38.22; 106/38.3; 106/38.35; 106/38.4

(58) Field of Search ..... 106/38.2, 38.22, 106/38.3, 38.35, 38.4

(56) References Cited

U.S. PATENT DOCUMENTS 4,113,499 A * 9/1978 Ivanov et al. ..... 106/38.35
4,530,722 A * 7/1985 Moore et al. ..... 106/38.35
5,217,929 A * 6/1993 Taft ..... 501/84

OTHER PUBLICATIONS

Patent Abstract of Japan, Publication No. 64–083357, Mar. 29, 1989.

Patent Abstract of Japan, Publication No. 03–000447, Jan. 7, 1991.

* cited by examiner

*Primary Examiner*—Michael Marcheschi
(74) *Attorney, Agent, or Firm*—Arent Fox Kintner Plotkin & Kahn PLLC

(57) ABSTRACT

A mold releasing agent suitable for easily casting a cylindrical cast member which is superior in adhesion on cast parts at low cost, is provided. A mold releasing agent for a centrifugal casting mold comprises a binder, a heat insulating agent, and a foaming component having a foaming property, is dissolved in a solvent so as to form a slurry having a specific viscosity, and a mold releasing agent layer having crater shaped concave portions is formed by coating on the inside of an integral centrifugal casting mold.

3 Claims, 3 Drawing Sheets

《0. 005wt%》

Sample 4

《0. 03wt%》

Sample 6

《0. 1wt%》

Sample 13

《0. 003wt%》

Sample 42

《0. 15wt%》

Sample 40

MOLD RELEASING AGENT FOR CENTRIFUGAL CASTING MOLD

FIELD OF THE INVENTION

The present invention relates to a mold releasing agent for coating on an inner surface of a centrifugal casting mold, and in particular, relates to a mold releasing agent suitable for forming fine protrusions on the outer surface of a cast member during a casting process so as to improve the adhesion of an interface between a base material and the cast member, in a production process of a cylindrical cast member in which the outer surface thereof is cast using various base materials, such as a cylinder sleeve for an internal combustion engine, an embedded bearing, etc.

BACKGROUND OF THE INVENTION

With respect to a cast member with a roughened outer surface formed by using a centrifugal casting method, a technique in which a tube member with a roughened outer surface is formed by casting after coarsely coating a facing material on an inner surface of a centrifugal casting mold, and then a wall material, a floor material, and a decorative plate member for buildings are obtained by cutting it open in the axial and circumferential direction, is disclosed in Japanese Unexamined Patent Publication No. 64-83357.

In addition, with respect to the facing material, for example, as disclosed in Japanese Unexamined Patent Publication No. 3-447, facing materials formed by combining a binder such as bentonite, kibushi clay, sodium aluminate, water glass, colloidal silica, etc., with a fiber material such as silica, chamotte, mullite, alumina, zirconia, carbon, silicon carbide, calcium silicate, potassium titanate, etc., have been proposed, in order to prevent bonding between casting metal and a metal mold or to prevent rapidly cooling of molten metal.

In recent years, as disclosed in Japanese Unexamined Patent Publication No. 9-108773, a mold releasing agent has been proposed, in which a mold releasing component; a dispersing component, and a foaming agent are mixed and foamed; the foam is filled in a metal mold in a clamped state; the mold releasing component is maintained in bubbles; and the mold releasing component is thereby prevented from separating and depositing.

In a production process of a cylindrical cast member cast using base materials, such as a cylinder sleeve for an internal combustion engine, an embedded bearing, etc., improvement in the adhesion of cast parts is required. As a method for improving the adhesion, conventionally, techniques have been proposed in which irregularities are provided on the outer surface of a sleeve by a machining process, etc., and in which irregularities are formed on an inner surface of split molds. However, these methods require a secondary process such as a machining process, resulting in subsequent increase in cost. Moreover, application of the split metal molds not only results in loss of productivity, but also requires that the metal mold be manufactured with excessively high precision and high durability in order to prevent molten metal intruding into the split mold surfaces by centrifugal force.

SUMMARY OF THE INVENTION

The present invention has been devised to solve the above-mentioned problems, and an object thereof is to provide a mold releasing agent in which a cylindrical cast member with superior adhesion in the cast part can be easily cast at low cost.

A mold releasing agent for a centrifugal casting mold of the present invention is a mold releasing agent for coating on an inner surface of an integral centrifugal casting mold, which comprises a binder, a heat insulating agent, and a solvent, the agent is in a slurry state, and is characterized by further comprising a foaming component having a foaming property (hereinafter, referred to as a foaming agent).

According to the mold releasing agent for a centrifugal casting mold constructed as above, bubbles are generated by the effect of vaporization of solvent in the mold releasing agent in a slurry state and a foaming agent, or by the effect of a foaming agent alone, and crater shaped concave portions are formed by traces in which the bubbles are released from the mold releasing agent. Then, the concave portions are transferred on the outer surface of the cast member so as to form fine protrusions, and therefore, there is no cost increase required for the operation for forming irregularities using a machining process, etc. Furthermore, since the cast member is integrally removed from the mold with the mold releasing agent of the present invention, there is no problem such as degradation in productivity due to use of split molds. Therefore, a cylindrical cast member having superior adhesion in cast parts can be easily obtained at low cost by using the mold releasing agent of the present invention.

DESCRIPTION OF THE INVENTION

In the following, a mold releasing agent for a centrifugal casting mold of the present invention, and a process for producing a cylindrical cast member having superior adhesion in cast parts, using the agent of the present invention, will be explained in detail.

The mold releasing agent for a centrifugal casting mold of the present invention is, for example, in a slurry state formed by dissolving a binder, a heat insulating agent, and a foaming agent in a solvent, and is preferably coated on an inner surface of a centrifugal casting mold by using a device such as a spray gun, etc.

As a binder in the mold releasing agent, bentonite, graphite, graphite fluoride, molybdenum disulfide, colloidal silica, sodium aluminate, and combinations thereof can be employed, and in particular, among these, bentonite is most preferable. Furthermore, as a heat insulating agent, diatomaceous earth, zircon, silica sand, chromite, sepiolite, alumina, mullite, silica, titanium oxide, and combinations thereof can be employed, and in particular, among these, diatomaceous earth, zircon, silica sand, and chromite are most preferable.

In addition, as a foaming agent in the present invention, surface active agents such as anionic surface active agents and nonionic surface active agents, protein-based foamable agents, and combinations of these, can be employed, and in particular, among these, anionic surface active agents and nonionic surface active agents are preferable.

Figure 4A:
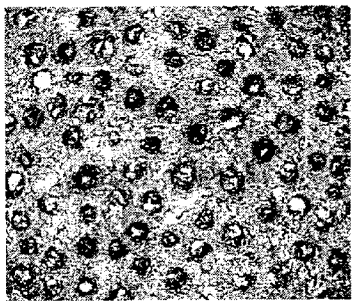
FIGS. 4A to 4C show a surface of a cylindrical cast member produced by using a mold releasing agent for a centrifugal casting mold of the present invention which contains a foaming agent in a preferable range.
Figure 4B:
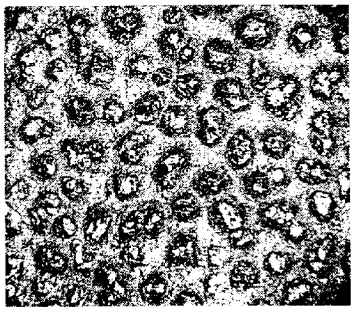
Figure 4C:
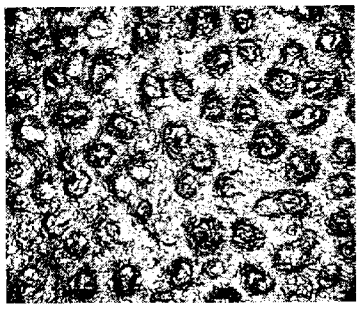
Figure 5A:
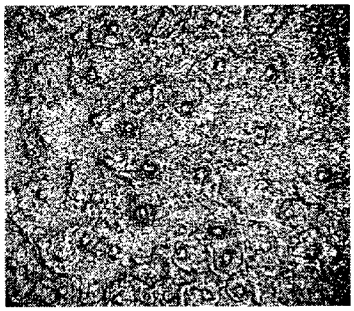
FIGS. 5A and 5B show a surface of a cylindrical cast member produced by using a mold releasing agent for a centrifugal casting mold of the present invention which contains a foaming agent outside a preferable range.
Figure 5B:
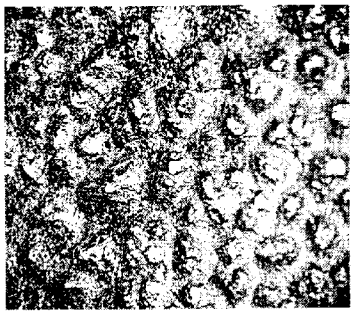

It is preferable that the foaming agent contained in the mold releasing agent of the present invention be contained at 0.005 to 0.1 wt % and that the solid component ratio thereof be 0.018 to 0.524 wt %. When the content of the foaming agent is within this range, virtually uniform fine protrusions are stably formed, as shown in FIGS. 4A to 4C. However, when the content of the foaming agent is under 0.005 wt % (solid component ratio: 0.018 wt %), a state in which fine protrusions are nonuniform and spaces form occurs, as shown in FIG. 5A. In contrast, when the content exceeds 0.1 wt % (solid component ratio: 0.524 wt %), excessive bubbles are generated and thereby fine protrusions are nonuniformly formed, as shown in FIG. 5B, and in addition, the entirety thereof swells too much and thereby fine protrusions are not appropriately formed.

It is preferable that the viscosity of the mold releasing agent in a slurry state of the present invention be 1 to 8 poise. When the viscosity is within this range, the mold releasing agent can be uniformly coated on an inner surface of a centrifugal casting mold, bubbles can be sufficiently generated by an effect of the foaming agent in the slurry after the coating process, and crater shaped concave portions can be nearly uniformly formed by utilizing these foams. The viscosity of the present invention is measured as follows: a mold releasing agent is dissolved in a solvent so as to be in a slurry state, and this is then allowed to stand for 24 hours, and the viscosity thereof is measured by a Leon viscometer.

When the viscosity of the mold releasing agent in a slurry state is less than 1 poise, appropriate crater shaped concave portions are insufficiently formed, fine protrusions formed by transferring these concave portions are too small or are unevenly arranged on the circumferential surface, and therefore, the adhesion of the cast part cannot be improved. In contrast, when the viscosity of the mold releasing agent in a slurry state exceeds 8 poise, it is too high to carry out an injection process using an injection device such as a spray gun, etc., and a coating having a uniform thickness cannot be formed. Therefore, it is proposed that the mold releasing agent be coated by using a brush, etc.; however, in this case, bubbles are generated directly after the coating since the metal mold temperature is high, and an appropriate coating surface cannot be sufficiently formed on an inner surface of the mold for a centrifugal casting mold.

Figure 1A:
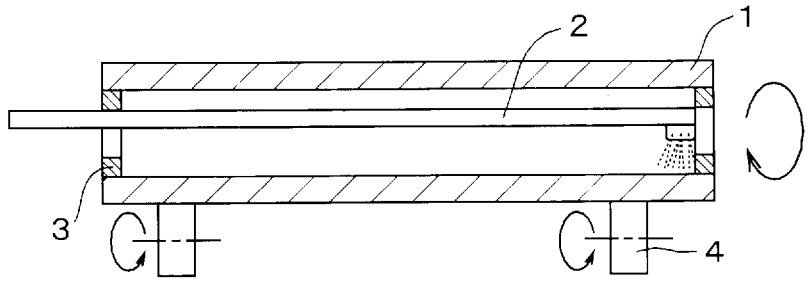
FIGS. 1A to 1D show a production process (a process inside a centrifugal casting mold) for a cylindrical cast member using a mold releasing agent for a centrifugal casting mold of the present invention.
Figure 1B:
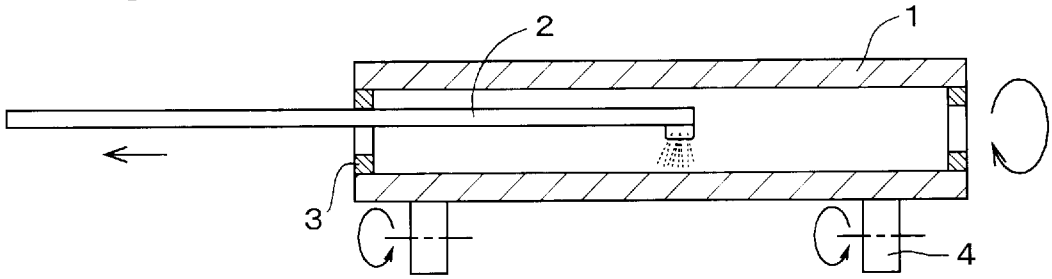

In a process for producing a cylindrical cast member having superior adhesion in the cast part by using the mold releasing agent for a centrifugal casting mold of the present invention, first, as shown in FIG. 1A, a centrifugal casting mold 1 provided with mold lid members 3 having an opening, at both ends thereof, is preliminarily rotated; a spray gun 2 is inserted through the opening of each mold lid member 3; then, as shown in FIG. 1B, the mold releasing agent for a centrifugal casting mold of the present invention is successively coated on an inner surface of the mold 1 by moving the spray gun 2. A centrifugal force is exerted on the coated mold releasing agent by rotation, so that the coating component and thickness are uniform on the inner surface of the mold 1. In addition, solvent in the mold releasing agent is rapidly evaporated by heat (residual heat due to a previous operation in the case of a repeated sintering process) of the preliminarily heated mold 1, and bubbles are generated and burst by an effect of the vaporization of solvent and a foaming agent contained therein or by an effect of the foaming agent alone, and the mold releasing agent layer is dried by further vaporizing the solvent. Thereafter, crater shaped recessed holes (concave portions) are formed by the bubbles bursting, and a mold releasing agent layer having crater shaped recessed holes (concave portions) is formed when the solvent is completely evaporated.

Figure 1C:
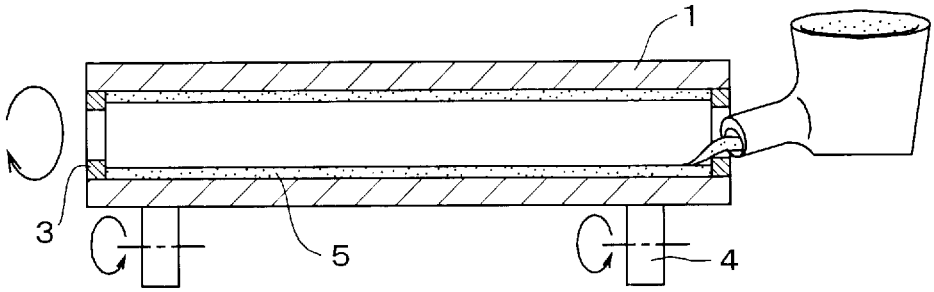
Figure 1D:
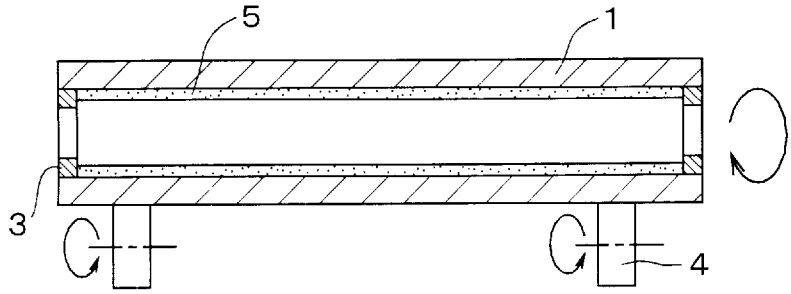

Next, as shown in FIG. 1C, the mold releasing agent is sufficiently cured and dried on an inner surface of the mold 1 which is rotated in the circumferential direction by a driving roller 4, and molten metal is then poured onto the inner surface of the mold 1. The molten metal is uniformly dispersed in the circumferential direction since a centrifugal force is exerted on the inner surface of the mold 1 by rotating. Furthermore, the molten metal is cast into the crater shaped concave portions on the mold releasing agent layer, and fine protrusions are transferred and formed on an interface between the mold releasing agent and a cylindrical cast member 5 (see FIG. 1D). These fine protrusions which are uniformly dispersed and formed on the outer circumferential surface, serve as anchors when these are cast in a base material of a cylindrical cast member such as a cylinder sleeve for an internal combustion engine, an embedded bearing, etc., and the adhesion of the cast part can thereby be improved. In addition, since the heights of these fine protrusions are not greater than the thickness of the mold releasing layer, the cylindrical cast member 5 after solidification is easily removed from the mold 1 with the mold releasing agent, as described below.

Figure 2A:
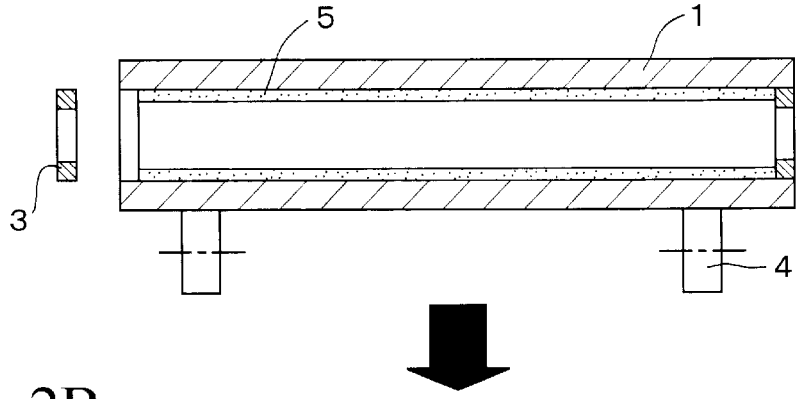
FIGS. 2A to 2D show a production process (a process outside a centrifugal casting mold) for a cylindrical cast member using a mold releasing agent for a centrifugal casting mold of the present invention.
Figure 2B:
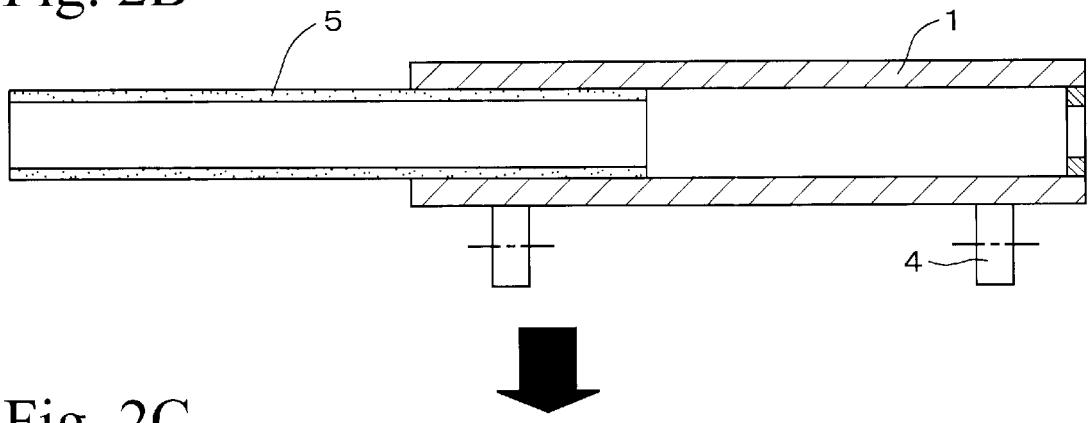

Next, as shown in FIG. 2A, one of the mold lid members 3 of the mold 1 is removed after the cylindrical cast member 5 has been completely solidified, and the cylindrical cast member 5 is taken out therefrom with the mold releasing agent of the present invention (FIG. 2B). Since the cylindrical cast member 5 is integrally formed with the mold releasing layer of the present invention, it can be easily removed from the mold 1 after solidification without a mold splitting process, although fine protrusions have been formed on the outer circumferential surface.

Figure 2C:
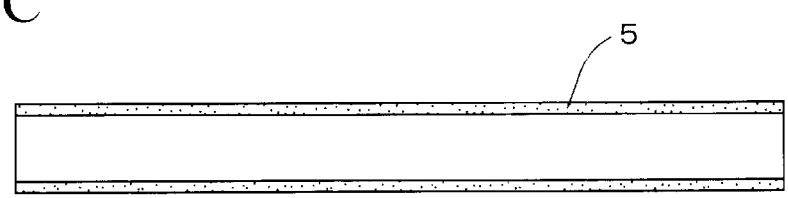
Figure 2D:
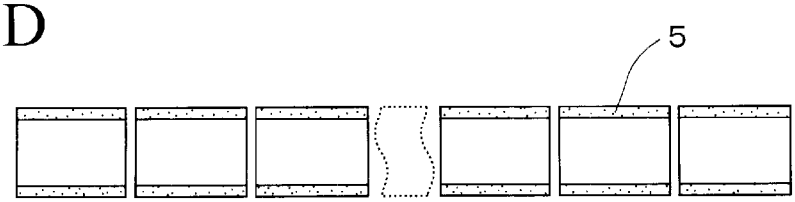
Figure 3:
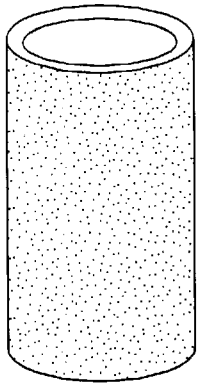
FIG. 3 shows one example of a cylindrical cast member produced by a mold releasing agent for a centrifugal casting mold of the present invention.

Then, the mold releasing agent on the surface of the cylindrical cast member 5 taken out from the mold 1 is removed (FIG. 2C). As this mold releasing agent removing process, a process such as a shot peening process, a shot blasting process, etc., are preferably employed. Thereafter, as shown in FIG. 2D, the cylindrical cast member 5 is cut into a desired shape, and a cylindrical cast member having superior adhesion in the cast part is thereby produced. FIG. 3 shows a cylinder sleeve for an internal combustion engine as one example of a cylindrical cast member produced by using a mold releasing agent for a centrifugal casting mold of the present invention.

EXAMPLES

In the following, the effects of the present invention will be explained by Examples of the present invention.

Sample 1

4 wt % of bentonite (binder), 15 wt % of diatomaceous earth (heat insulating agent), and 0.005 wt % of an anionic surface active agent (foaming agent) were dissolved in pure water (solvent) to prepare a mold-releasing agent for a centrifugal casting mold in a slurry state having a viscosity of 2.1 poise. Next, a centrifugal casting mold of a length of 2 m and a diameter of 150 mm provided with mold lid members having an opening, at both ends thereof, was preliminarily heated to 250° C., or in the case in which casting processes were repeatedly carried out, the mold temperature after previous casting process was maintained at 250° C. Then, a spray gun was inserted to the inner surface of the mold through the opening on the mold lid member of the mold rotated in the circumferential direction by a driving roller, and was moved in the axial direction, and the above mold-releasing agent in a slurry state was thereby coated on the inner surface of the mold so as to have a coat thickness of 1 mm.

Consequently, water in the mold releasing agent was rapidly vaporized by heat of the heated mold, bubbles were formed as a result of steam and the anionic surface active agent, and the bubbles then burst, and crater shaped concave portions were thereby formed on the surface of the mold releasing agent layer which was then to be cured. Thereafter, water was further vaporized so that the mold releasing agent layer with the crater shaped concave portions was sufficiently dried. Next, molten metal was poured on the inner surface of the centrifugal casting mold which was rotated in the circumferential direction by the driving roller, on which the above mold releasing agent layer had been formed, and was uniformly dispersed in the circumferential direction by utilizing a centrifugal force, and a cylindrical cast member provided with fine protrusions, which were transferred and formed on the interface to the mold releasing agent, on the outer surface thereof, was thereby produced.

Next, after the cylindrical cast member 5 had been completely solidified, one of the mold lid members of the mold was removed, and the cylindrical cast member formed integrally with the mold releasing layer was removed and taken out therefrom. Then, the mold releasing agent on the surface of the cylindrical cast member taken out from the mold was removed by a shot blasting process, the cylindrical cast member was cut in the circumferential direction, and a cylindrical cast member of Sample 1 formed by using an embodiment of the present invention was thereby produced.

Samples 2 to 37

Cylindrical cast members of Samples 2 to 37 formed by using embodiments of the present invention were produced in the same manner as in Sample 1, except that the component compositions and ratios of the mold releasing agent in a slurry state were changed as shown in Tables 1 and 2.

TABLE 1

| | Component rate and viscosity of mold releasing agent in slurry state | | | | | | Component rate of mold releasing agent after evaporating solvent | | | |
|---|---|---|---|---|---|---|---|---|---|---|
| | Binder (wt %) | Heat insulating agent (wt %) | Solvent (Pure water) (wt %) | Foaming agent (Anionic surface active agent) (wt %) | Viscosity (poise) | Binder (wt %) | Heat insulating agent (wt %) | Foaming agent (Anionic surface active agent) (wt %) | Fine protrusion shape evaluation |
| Sample 1 | bentonite 4 | diatomaceous earth 15 | 80.995 | 0.005 | 2.1 | 21.05 | 78.93 | 0.026 | Good |
| Sample 2 | bentonite 4 | diatomaceous earth 20 | 75.97 | 0.03 | 2.9 | 16.65 | 83.23 | 0.125 | Good |
| Sample 3 | bentonite 4 | diatomaceous earth 25 | 70.9 | 0.1 | 3.8 | 13.75 | 85.91 | 0.344 | Good |
| Sample 4 | bentonite 5 | diatomaceous earth 15 | 79.995 | 0.005 | 2.8 | 24.99 | 74.98 | 0.025 | Good |
| Sample 5 | bentonite 5 | diatomaceous earth 16 | 78.99 | 0.01 | 3.0 | 23.80 | 76.15 | 0.048 | Good |
| Sample 6 | bentonite 5 | diatomaceous earth 18 | 76.97 | 0.03 | 3.0 | 21.71 | 78.16 | 0.130 | Good |
| Sample 7 | bentonite 5 | diatomaceous earth 20 | 74.9 | 0.1 | 3.3 | 19.92 | 79.68 | 0.398 | Good |
| Sample 8 | bentonite 5 | diatomaceous earth 22 | 72.9 | 0.1 | 4.1 | 18.45 | 81.18 | 0.369 | Good |
| Sample 9 | bentonite 5 | diatomaceous earth 25 | 69.94 | 0.06 | 4.5 | 16.63 | 83.17 | 0.200 | Good |
| Sample 10 | bentonite 6 | diatomaceous earth 15 | 76.99 | 0.01 | 3.8 | 28.56 | 71.39 | 0.048 | Good |
| Sample 11 | bentonite 6 | diatomaceous earth 16 | 77.995 | 0.005 | 4.0 | 27.27 | 72.71 | 0.023 | Good |
| Sample 12 | bentonite 6 | diatomaceous earth 18 | 75.97 | 0.03 | 4.4 | 24.97 | 74.91 | 0.125 | Good |
| Sample 13 | bentonite 6 | diatomaceous earth 20 | 73.9 | 0.1 | 4.8 | 22.99 | 76.63 | 0.383 | Good |
| Sample 14 | bentonite 6 | diatomaceous earth 22 | 71.995 | 0.005 | 5.0 | 21.42 | 78.56 | 0.018 | Good |
| Sample 15 | bentonite 6 | diatomaceous earth 25 | 68.94 | 0.06 | 5.2 | 19.32 | 80.49 | 0.193 | Good |
| Sample 16 | bentonite 7 | diatomaceous earth 15 | 77.99 | 0.01 | 4.2 | 31.80 | 68.15 | 0.045 | Good |
| Sample 17 | bentonite 7 | diatomaceous earth 16 | 76.995 | 0.005 | 4.5 | 30.43 | 69.55 | 0.022 | Good |
| Sample 18 | bentonite 7 | diatomaceous earth 18 | 74.97 | 0.03 | 4.8 | 27.97 | 71.91 | 0.120 | Good |
| Sample 19 | bentonite 7 | diatomaceous earth 20 | 72.97 | 0.03 | 5.0 | 25.90 | 73.99 | 0.111 | Good |
| Sample 20 | bentonite 7 | diatomaceous earth 22 | 70.9 | 0.1 | 5.5 | 24.05 | 75.60 | 0.344 | Good |

TABLE 1-continued

| | Component rate and viscosity of mold releasing agent in slurry state | | | | | | | Component rate of mold releasing agent after evaporating solvent | | | |
|---|---|---|---|---|---|---|---|---|---|---|---|
| | Binder (wt %) | | Heat insulating agent (wt %) | | Solvent (Pure water) (wt %) | Foaming agent (Anionic surface active agent) (wt %) | Viscosity (poise) | Binder (wt %) | Heat insulating agent (wt %) | Foaming agent (Anionic surface active agent) (wt %) | Fine protrusion shape evaluation |
| Sample 21 | bentonite | 7 | diatomaceous earth | 25 | 67.94 | 0.06 | 6.1 | 21.83 | 77.98 | 0.187 | Good |
| Sample 22 | bentonite | 8 | diatomaceous earth | 15 | 76.9 | 0.1 | 5.2 | 34.63 | 64.94 | 0.433 | Good |
| Sample 23 | bentonite | 8 | diatomaceous earth | 20 | 71.995 | 0.005 | 6.4 | 28.57 | 71.42 | 0.018 | Good |
| Sample 24 | bentonite | 8 | diatomaceous earth | 25 | 66.94 | 0.06 | 8.0 | 24.20 | 75.62 | 0.181 | Good |

TABLE 2

| | Component rate and viscosity of mold releasing agent in slurry state | | | | | | | Component rate of mold releasing agent after evaporating solvent | | | |
|---|---|---|---|---|---|---|---|---|---|---|---|
| | Binder (wt %) | | Heat insulating agent (wt %) | | (Pure water) (wt %) | Foaming agent (Anionic surface active agent) (wt %) | Viscosity (poise) | Binder (wt %) | Heat agent (wt %) | Foaming agent (Anionic surface active agent) (wt %) | Fine protrusion shape evaluation |
| Sample 25 | bentonite | 4 | silica sand | 15 | 80.9 | 0.1 | 1.0 | 20.94 | 78.53 | 0.524 | Good |
| Sample 26 | bentonite | 4 | silica sand | 25 | 70.94 | 0.06 | 2.8 | 13.76 | 86.03 | 0.206 | Good |
| Sample 27 | bentonite | 5 | silica sand | 20 | 74.9 | 0.1 | 3.0 | 19.92 | 79.68 | 0.398 | Good |
| Sample 28 | bentonite | 6 | silica sand | 25 | 68.97 | 0.03 | 4.3 | 19.34 | 80.57 | 0.097 | Good |
| Sample 29 | bentonite | 7 | silica sand | 15 | 77.94 | 0.06 | 3.5 | 31.73 | 68.00 | 0.272 | Good |
| Sample 30 | bentonite | 4 | zircon | 15 | 80.9 | 0.1 | 1.3 | 20.94 | 78.53 | 0.524 | Good |
| Sample 31 | bentonite | 5 | zircon | 20 | 74.94 | 0.06 | 3.4 | 19.95 | 79.81 | 0.239 | Good |
| Sample 32 | bentonite | 6 | zircon | 25 | 68.9 | 0.1 | 4.5 | 19.29 | 80.39 | 0.322 | Good |
| Sample 33 | bentonite | 7 | zircon | 15 | 77.97 | 0.03 | 3.9 | 31.77 | 68.09 | 0.136 | Good |
| Sample 34 | bentonite | 4 | chromite | 20 | 75.94 | 0.06 | 1.8 | 16.63 | 83.13 | 0.249 | Good |
| Sample 35 | bentonite | 5 | chromite | 15 | 79.9 | 0.1 | 2.3 | 24.88 | 74.63 | 0.498 | Good |
| Sample 36 | bentonite | 6 | chromite | 15 | 68.94 | 0.06 | 4.3 | 19.32 | 80.49 | 0.193 | Good |
| Sample 37 | bentonite | 7 | chromite | 20 | 72.9 | 0.1 | 3.9 | 25.83 | 73.80 | 0.369 | Good |
| Sample 38 | bentonite | 4 | zircon | 14 | 81.997 | 0.003 | 0.5 | 22.22 | 77.76 | 0.017 | Small protrusions, Nonuniform |
| Sample 39 | bentonite | 8 | diato-maceous earth | 14 | 77.997 | 0.003 | 0.8 | 36.36 | 63.63 | 0.014 | Small protrusions, Nonuniform |
| Sample 40 | bentonite | 4 | diato-maceous earth | 16 | 79.85 | 0.15 | 2.0 | 19.85 | 79.40 | 0.744 | Unstable protrusion shape |
| Sample 41 | bentonite | 8 | zircon | 18 | 73.7 | 0.3 | 5.0 | 30.42 | 68.44 | 1.141 | Unstable protrusion shape |
| Sample 42 | bentonite | 6 | chromite | 20 | 73.997 | 0.003 | 4.0 | 23.07 | 76.91 | 0.012 | Small protrusions, Nonuniform |
| Sample 43 | bentonite | 7.5 | chromite | 26 | 66.45 | 0.05 | 10.0 | 22.35 | 77.50 | 0.149 | Impossible to uniformly coat |
| Sample 44 | bentonite | 8 | diato-maceous earth | 27 | 64.95 | 0.05 | 11.0 | 22.82 | 77.03 | 0.143 | Impossible to uniformly coat |

Samples 38 to 44

Cylindrical cast members of Samples 38 to 44 were produced in the same manner as in Sample 1, except that the component compositions and ratios of the mold releasing agent in a slurry state were changed as shown in Table 2. The cylindrical cast members of these Samples 38 to 44 were produced by using mold releasing agents in which the content of the foaming agent and the viscosity of the mold releasing agent deviated from preferable ranges in order to compare and test them.

By using the above cylindrical cast members of the Samples 1 to 44, the shape of fine protrusions formed on the surface was visually observed and evaluated. As a result, in the cylindrical cast members of the Samples 1 to 37 in which the contents of the foaming agent and the viscosities of the mold releasing agent were within the preferable ranges of the present invention, the adhesion of the cast part was further improved since fine protrusions having an appropriate shape were uniformly placed on the outer circumferential surface thereof. In contrast, in the Samples 38, 39, and 42 in which the contents of the foaming agent were 0.003 wt % and were less than the preferable range, protrusions were rather small and were insufficient to improve the adhesion of the cast part, and these protrusions were not uniformly arranged. In addition, in the Samples 40 and 41 in which the contents of the foaming agent were within 0.15 or 0.3 wt % and were greater than the preferable range, there were deviations in the shape of the fine protrusions, and improvements of the adhesion in the cast part were only slight. Furthermore, in the Samples 43 and 44 in which the viscosities of the mold releasing agent in a slurry state were 10.0 and 11.0 poise and exceeded the preferable range, it was difficult to uniformly coat the mold releasing agent on the inner surface of the mold and the adhesions to the cast part of the resulting cylindrical cast member were not improved very much.

What is claimed is:

1. A mold releasing agent for a centrifugal casting mold for coating on an inner surface of an integral centrifugal casting mold, comprising a binder, a heat insulating agent, a solvent, and a foaming component having a foaming property, wherein said mold releasing agent is in a slurry state and has a viscosity of 1 to 8 poise.

2. A mold releasing agent for a centrifugal casting mold according to claim 1, wherein said foaming component is contained in a range of 0.005 to 0.1 wt %.

3. A mold releasing agent for a centrifugal casting mold according to claim 1, wherein said foaming component is contained in a range of 0.018 to 0.524 wt % in a solid component ratio.

* * * * *